United States Patent [19]

Post, Jr. et al.

[11] Patent Number: 4,967,520

[45] Date of Patent: Nov. 6, 1990

[54] PALLETIZED PRE-CUT BUILDINGS

[75] Inventors: Russell H. Post, Jr., Kinston, N.H.; Mark R. Post, 86 Nottingham Rd., Raymond, N.H. 03077

[73] Assignee: Mark R. Post, Raymond, N.H.

[21] Appl. No.: 380,136

[22] Filed: Jul. 14, 1989

[51] Int. Cl.[5] ..... E04H 1/12; E04B 1/343

[52] U.S. Cl. ..... 52/79.5

[58] Field of Search ..... 52/79.5, 143, 284, 288, 52/79.1, 66

[56] References Cited

U.S. PATENT DOCUMENTS

| | | | |
|---|---|---|---|
| 3,425,472 | 2/1969 | Marino | 108/55.1 |
| 4,071,984 | 2/1978 | Larrow | 50/79.1 |
| 4,272,930 | 6/1981 | Foster | 52/79.1 |
| 4,637,179 | 1/1987 | Bigelow | 52/79.5 |

FOREIGN PATENT DOCUMENTS

| | | | |
|---|---|---|---|
| 1581473 | 9/1969 | France | 52/79.1 |
| 2075083 | 11/1981 | United Kingdom | 52/79.5 |

*Primary Examiner*—John E. Murtagh

*Attorney, Agent, or Firm*—Lee A. Strimbeck

[57] ABSTRACT

A palletized pre-cut modular small building that requires no wood cutting to assemble is constructed from four foot wide modules of plywood sheets no larger than 4×8 feet and 2×4's for the joists, studs, floor plates, headers and rafters. The design of the modules is such that they can be stacked to give a sturdy 4×8 foot pallet. The modules include besides floor and wall modules, door and window modules. Small components including pre-cut rafters, truss points and trim are shipped in the pallet between the upturned joists of the bottom most floor panel of the pallet.

13 Claims, 2 Drawing Sheets

PALLETIZED PRE-CUT BUILDINGS

This invention is concerned with the construction of pre-cut small buildings such as storage and garden sheds, utility buildings and pool houses. It is more particularly concerned with a modular design for such buildings permitting the component parts to be compactly palletized for economical shipping while permitting ready assembly of the buildings without the need of sawing or cutting.

BACKGROUND

Small inexpensive pre-cut or pre constructed buildings of simple plywood/2×4 construction are well accepted additions to America's back yards and pool areas. They have convenient sizes such as 4×8 or 8×16 feet. These buildings are often assembled by the manufacturer and transported by truck to the purchasers property. This method of shipping is expensive and the area of delivery is consequently quite limited. Alternatively, unassembled building kits are offered as they are much more economical to ship. However, the assemblies of such buildings is not usually well thought out and the purchaser is usually required to do a goodly amount of figuring and cutting to put it together—often much to the frustration of the purchaser.

There has been a desideratum for a well designed and thought out pre-cut small building or shed that can be shipped in sturdy, compact palletized form and yet that can be readily assembled by the purchaser without the need for any cutting or sawing. Such pallets would extend considerably the geographic area to which manufacturers can economically market such buildings. The present invention is addressed to this need.

DEFINITIONS

As used in the following description and in the claims, the word "sheet" means a plywood, chipboard, or other flat building material ¼ to 1 inch thick that can be sawed or otherwise cut to prepare siding, roofs and floors of small buildings. The word "board" should be taken to mean lumber, rectangular in cross section and having a thickness equal to at least ½ its width such as a standard 2×4 having actual dimensions of 1¾ inch by 3¾ inch. The boards have a thickness of preferably at least 1½ inches.

THIS INVENTION

The present invention is a rectangular preferably 4×8 foot palletized, pre-cut modular small building requiring no wood cutting to assemble and built largely of sheet at least ¼ inch thick, and preferably at least 11/32 inch thick for the siding and ⅝ inch thick for the flooring and of boards all the same size for joists, studding, plates and rafters. None of the sheets and panels have a size greater then 4×8 feet.

The basic package sufficient for a 4×8 foot shed comprises 4 foot wide modular panels, viz:

a. A 4×8 foot floor panel comprising a sheet rimmed with board and having joists within the rim;
b. Two pair of 4 foot wide end walls of sheets each with floor, header and studs of the board, each pair at the top forming a gable;
c. A 4 foot wide back panel of the sheet having a floor plate, header and studs of the board and being at least six foot high;

d. A 4 foot wide door unit having a floor plate, header and studs of the board and having a pre-hung door of the sheet with the interior side of the door being internally ribbed with the board;

The package also includes the roof sheets, none of which are larger than 4×8 feet, and precut rafters, truss points and trim. All of the headers are preferably at the same height, e.g. 6 feet 3 inches.

The above components are palletized in the following sequence from bottom to top:

1. A floor unit at the bottom with joists up and with building components between said joists including the precut rafters, truss points and trim.
2. The end wall, back and door panels being thereon and
3. A roof sheet on the top The pallet thus formed may be bagged and externally strapped as with plastic strapping. The pallet is very compact and will accept substantial abuse during shipping without the components suffering any appreciable damage.

It is preferred that the basic unit palletized and shipped be sufficient to construct a building 8 foot wide and 8 foot deep. To do so the pallet includes two floor panels, two back panels, the two pair of end walls, a front panel and the door unit. The manner of construction is such that the front panel is the same as a back panel and one of them may have a prefabricated window unit. Also, one of the pairs of end walls or both are aperatured at the gable end to receive a premanufactured metal louver.

Each of the end walls, back panels, door unit, and floor panel are rimmed with the board on their interior walls. The studs and joists are placed within the rims.

The roof trusses are shipped unassembled although the rafters and truss points are pre-cut. A floor panel has preferably jig blocks placed on it to hold the rafters and truss points for ready assembly by nailing.

In assembling the pallet, the bottom unit is a floor panel with the joists up. Placed in between these joists are the rafters, truss points, louvers, nails, precut trim, window boxes and other small components for the building. Placed on top of the joists is another panel such as an end wall panel face down which serves effectively to contain the small parts within the joists.

The walls of the building extend slightly beyond the floor plate so that when the building is assembled, the walls overlap the floor panel. Also, the outer studs of the front and back units are placed at the edges of the sheets while the outer studs of the end wall units are inset 2 to 3 inches whereby the vertical edges of the sheets of the end walls extend over the outer studs of the front and back panels when the building is assembled. Trim of, say, 1×2 is used to cover any gap between the vertical edges of the plywood sheets.

In keeping with the modular concept of this invention, when the purchaser desires a building larger than the preferred standard size 8×8 module, one or more additional separate pallets of a 4 foot module are shipped with the basic 8×8 foot module to permit construction of a building 12 feet, 16 feet or longer. Each 4 foot module pallet includes one of the 4×8 foot floor panels as a base with additional rafters, truss points and trim contained between the joists; another back panel and either an additional back panel or a front window panel; and the additional roof sheets.

The shingles for the buildings and the concrete blocks or the like upon which the building is to be places are not shipped and the customer is expected to buy these locally.

It can be appreciated from the foregoing description that the modular construction of the manufactured buildings of the present invention permit maximum use of standard 4×8 foot plywood sheets.

THE DRAWINGS

DESCRIPTION

Figure 1:
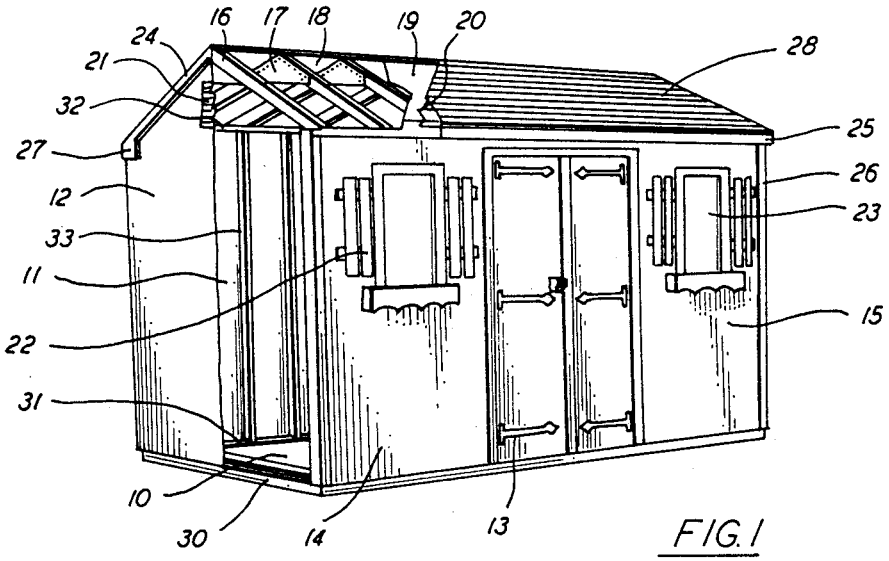
FIG. 1 is a perspective view of an 8 foot by 12 foot shed of this invention in part broken away to show the interior construction.

Referring to FIG. 1, illustrated is an 8×12 foot shed that could be used for a garden house, pool cabana, or tool storage.

It consists of the following main structural parts with reference to the numerals on the drawing:

10—floor panel (3)
11—back wall panel (3)
12—gable end panel (4)
13—door panel (1)
14,15—window panel (2)
16—rafter (24)
17—truss point (12)
18—4×4 roof plywood
19—4×8 roof plywood
20—6 inch wide roof plywood strip
21—aluminum louver
22,23—window units with associated trim All of the panels are 4 foot wide.

Additional components include rake trim 24, soffet and facia 25, corner trim 26, and rake return 27. The roof is shingled 28 with asphalt shingles but the shingles are not supplied with the pallet Internally, each of the floor panels 10 are rimmed with 2×4 30 and the joists (not shown) on 16 inch centers are panels. Also, for the wall panel, the plywood sheet 61 extends about an inch at 68 beyond the plate 65 so that when the walls are placed on the floor panel the plywood sheet 61 overlaps the floor panel.

Figure 3:
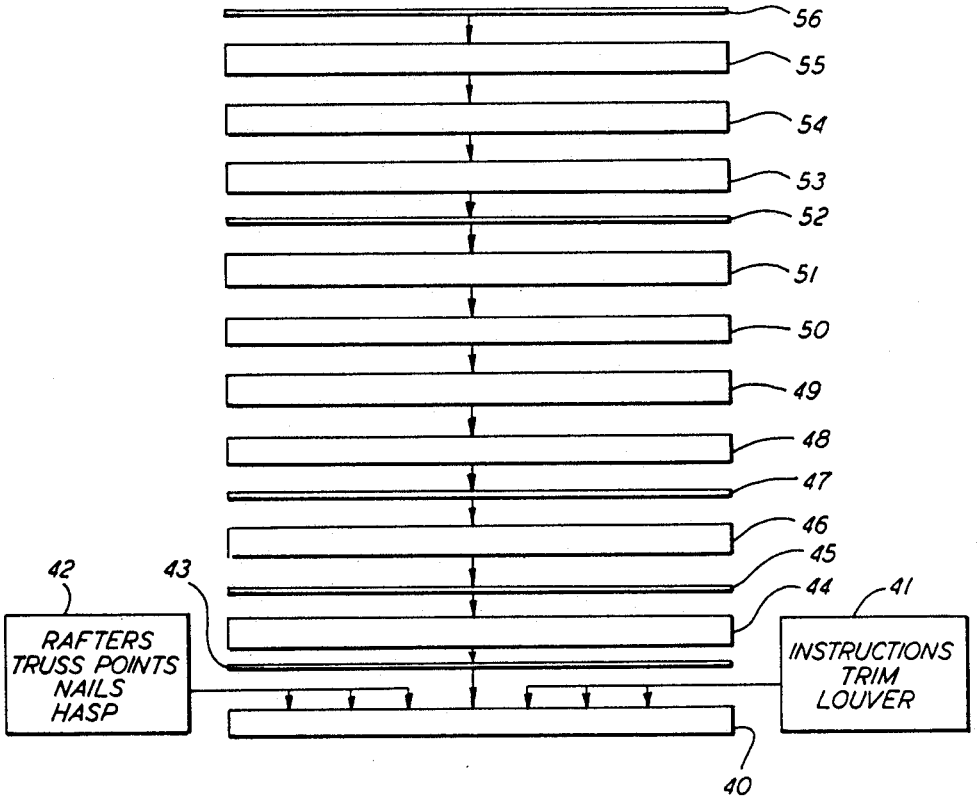
FIG. 3 is a schematic illustration of the assembly of a pallet for an 8×8 foot building constructed according to this invention.

FIG. 3 illustrates how a pallet of this invention is assembled for a 8 foot by 8 foot building. First a floor panel 40 with the joists up has placed between the joists the various smaller items 41 and 42 necessary for the assembly of the building. These include instructions, trim, a louver, the rafters, the truss points, nails, hasp, window box, and small trim. This package is then closed off by having placed on it some of the longer facia or trim 43 followed by one of the end wall panels 44 with the studs down. Thereafter some of the smaller roofing strips 45 is placed on panel 44 followed by another end wall panel 46, studs up, and a 4×8 sheet 47 of the roof plywood. Back wall panel 48, studs down, is placed on the sandwich followed by a back wall panel 49, studs up, a window or front panel 50, studs down and then the door panel 51, studs down. This gives a flat surface upon which further of the soffet strips and other trim 52 can be placed to be held thereon by another end wall panel 53, studs down. The pallet is finished by placing the final end wall panel 54 on top, studs down, the floor panel 55 containing the jig blocks, studs up so that the blocks rest against the top of panel 54 and finally the final 4×8 foot sheet 56 of the roof plywood to give a neat top surface.

It can be seen that all of the materials of the pallet are utilized in the construction of the building and that no extraneous reinforcement to permit shipping is required.

The pallet of FIG. 3 when assembled is bagged with waterproof covering and strapped. If ⅜ inch plywood and standard 2×4's are used for the panel construction, which is preferred, and the trim is 1×2 the whole of the palletized building when bagged will have a compact heighth of less than 41 inches and will weigh less than 700 pounds. It is easily handled therefor by a forklift truck and many of the palletized bundles can be placed on a flat bed truck for transportation. They can be stacked in two, three or more high without any damage to the building materials. The heaviest panel weighs less than 85 pounds which permits easy assembly of the building walls, for example, by a man and his wife.

A building is assembled from the palletized units in 9 steps:

1. The floor panel with the jig blocks in place is used to assemble the trusses from the truss points and the rafters.
2. The floor is placed on cement or patio block with care being taken to make sure that it is level. The panels are then spiked together if there is more than one.
3. A back wall panel and one end wall panel are placed on the floor to form a corner and nailed together. All the remaining wall panels and door units are then added around the floor panel, being nailed as required.
4. The top of the front and back wall header plates are marked on 16 inch centers to receive the roof trusses.
5. The roof trusses are then nailed in place.
6. The roof sheathing is nailed in place.
7. The trim and hardware are installed.
8. The roof is shingled.
9. The completed building is painted or stained as desired.

Figure 4:
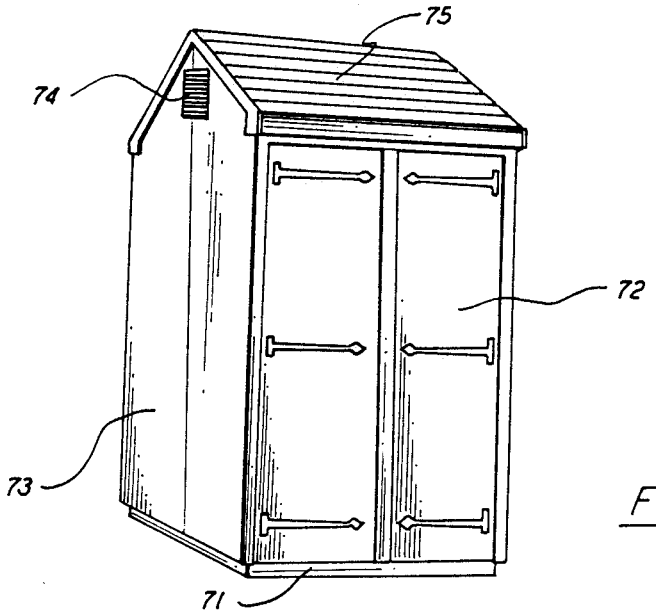
FIG. 4 is a small 4×8 shed of this invention.
Figure 2:
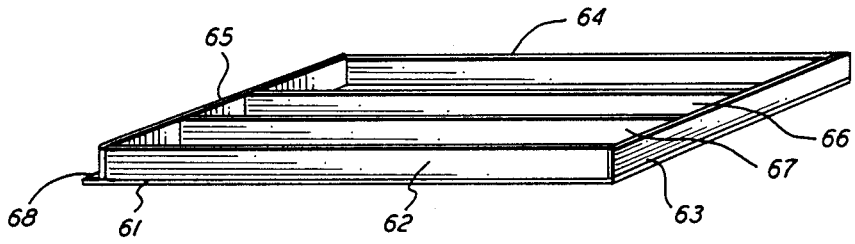
FIG. 2 is a perspective of a panel, showing the construction thereof.

FIG. 4 illustrates a small 4×8 foot building of this invention. It comprises a 4×8 floor panel 71, a door unit 72 as the front panel, the two pairs of end wall units 73 (right side not illustrated) each of which has an aluminum louver 74. There is a back panel (not illustrated) and the roof 75 is constructed as previously described.

Having described this invention, what is sought to be protected by Letters Patent is succinctly set forth in the following claims.

We claim:

1. A rectangular palletized pre-cut modular small building requiring no wood cutting to assemble and built largely of sheet at least ¼ inch thick and boards with a thickness of at least 1½ inch, said building being 8 feet deep and at least 4 feet wide, the pallet comprising the following units none of which are larger than 4×8 feet:

a. a 4×8 foot floor panel of said sheet rimmed with said board and having joists of said board within said rim:

b. two pair of 4 foot wide end walls of said sheet each with a floor plate, header and studs of said board, each pair at the top forming a gable;

c. a rectangular 4 foot wide back pane of said sheet having a floor plate, header and studs of said board and being at least six foot three inches high;

d. a rectangular 4 foot wide door unit having a floor plate, header and studs of said board and having a pre-hung door of said sheet with said door being internally ribbed with said board;

e. roof panels of said sheet, and f. precut rafters of said board, truss points and trim; said units being palletized as follows:

1. said floor panel at the bottom with the joists up and with building components between said joists including said precut rafters, truss points and trim.
2. said end walls, back panel and door unit thereon, and
3. one of said roof panels as the last item on the top of the pallet, there being no materials on said pallet not utilized in the construction of said building.

2. The building of claim 1 wherein the said studs of said door unit and back panel to the outside edges thereof are at the edges thereof and the said studs of said end walls to the outside edges thereof are inset such that the vertical edges of said sheets of said end walls extend over the outer studs of said door unit and back panels when the building is assembled.

3. The building of claim 2 wherein the bottom of the sheets of said end walls and back panels extend at least one inch beyond their respective floor plates whereby said sheets overlap said floor panel when the building is assembled.

4. The building of claim 2 wherein the assembled pallet is bagged in a waterproof covering and externally strapped for shipping.

5. The building of claim 2 wherein the amount of palletized material is sufficient to construct a building 8 foot wide and 8 foot deep and includes in addition:

i. a window panel of a sheet having a window opening and a floor plate, header, and studs of said board, ii. at least two each of said back panels and floor panels, and iii. a louver placed between the joists of the bottom floor unit of the pallet, a pair of said end walls having an opening centrally therein to receive said louver.

6. The building of claim 2 wherein said floor unit has jig blocks attached thereto to facilitate the assembly of the roof trusses from said precut rafters and truss points.

7. The building of claim 6 wherein the floor unit with the jig blocks is placed face down at the top of the pallet just below a roof sheet.

8. The building of claim 7 wherein said sheet is $\frac{3}{8}$ inch thick plywood and said boards are standard 2×4's, the weight of the pallet for an 8×8 foot building being less than 700 lbs.

9. The building of claim 8 wherein in addition to a pallet for an 8×8 foot building a separate pallet of a 4 foot module is shipped therewith to permit construction of a building 8 feet deep and at least 12 feet long, said 4 foot module comprising:

i. one of said 4×8 foot floor panels as a base for the pallet with additional rafters and truss points and trim being placed between the joist thereof, ii. another of said back panel and either an additional back panel or a window panel, and iii. roof sheets.

10. A building assembled from the pallet of claim 4.

11. A building assembled from the pallet of claim 5.

12. A building assembled from the pallet of claim 1.

13. A building assembled from a rectangular pallet of pre-cut materials therefor without the need of wood cutting to assemble, said building being largely of sheet at least $\frac{1}{4}$ inch thick and boards with a thickness of at least $1\frac{1}{2}$ inch, said building being 8 feet deep and at least 4 feet wide, said pallet comprising he following units none of which are larger than 4×8 feet:

a. a 4×8 foot floor panel of said sheet rimmed with said board and having joists of said board within said rim;

b. two pair of 4 foot wide end walls of said sheet each with a floor plate, header and studs of said board, each pair at the top forming a gable;

c. a rectangular 4 foot wide back panel of said sheet having a floor plate, header and studs of said board and being at least six foot three inches high;

d. a rectangular 4 foot wide door unit having a floor plate, header and studs of said board and having a pre-hung door of said sheet with said door being internally ribbed with said board;

e. roof panels of said sheet, and f. precut rafters of said board, truss points and trim;

said studs of said door unit and back panel to the outside edges thereof being at the edges thereof and the said studs of said end walls to the outside edges thereof being inset such that the vertical edges of said sheets of said end walls extend over the outer studs of said door unit and back panels when the building is assembled; and said floor unit having jig blocks attached thereto to facilitate the assembly of the roof trusses from said precut rafters and truss points.

* * * * *